US010119680B2

(12) United States Patent
Engelhardt

(10) Patent No.: US 10,119,680 B2
(45) Date of Patent: Nov. 6, 2018

(54) RETROFIT LIGHT EMITTING DIODE FIXTURE FOR A BACK BOX

(71) Applicant: Gary Wayne Engelhardt, San Jose, CA (US)

(72) Inventor: Gary Wayne Engelhardt, San Jose, CA (US)

( * ) Notice: Subject to any disclaimer, the term of this patent is extended or adjusted under 35 U.S.C. 154(b) by 0 days.

(21) Appl. No.: 15/083,279

(22) Filed: Mar. 28, 2016

(65) Prior Publication Data

US 2016/0281958 A1 Sep. 29, 2016

Related U.S. Application Data

(60) Provisional application No. 62/139,500, filed on Mar. 27, 2015.

(51) Int. Cl.

| | |
|---|---|
| ***F21V 7/04*** | (2006.01) |
| ***F21V 7/00*** | (2006.01) |
| ***F21K 9/20*** | (2016.01) |
| *F21V 3/06* | (2018.01) |
| *F21V 5/04* | (2006.01) |
| *F21Y 113/00* | (2016.01) |
| *F21Y 103/10* | (2016.01) |
| *F21Y 115/10* | (2016.01) |

(52) U.S. Cl.

CPC ..... *F21V 7/04* (2013.01); *F21K 9/20* (2016.08); *F21V 7/005* (2013.01); *F21V 3/062* (2018.02); *F21V 5/04* (2013.01); *F21Y 2103/10* (2016.08); *F21Y 2113/00* (2013.01); *F21Y 2115/10* (2016.08)

(58) Field of Classification Search

CPC ..... F21V 7/04; F21V 7/005; F21K 9/20
USPC ..... 362/221
See application file for complete search history.

(56) References Cited

U.S. PATENT DOCUMENTS

| | | | | |
|---|---|---|---|---|
| 6,210,028 | B1 * | 4/2001 | Murakoshi | F21S 48/1258 313/112 |
| 2005/0201098 | A1 * | 9/2005 | DiPenti | F21S 8/02 362/294 |
| 2007/0189019 | A1 * | 8/2007 | Klipstein | F21S 6/003 362/347 |
| 2009/0122541 | A1 * | 5/2009 | Suehiro | F21K 9/00 362/235 |
| 2009/0135606 | A1 * | 5/2009 | Young | F21V 7/0025 362/310 |
| 2009/0168395 | A1 * | 7/2009 | Mrakovich | F21S 8/032 362/84 |
| 2012/0201023 | A1 * | 8/2012 | Yoneda | F21S 4/00 362/218 |

(Continued)

*Primary Examiner* — Bryon T Gyllstrom

(57) ABSTRACT

An LED fixture apparatus has a base plate, a light directing fixture, a low transparency lens, a light source assembly, two white optics reflectors, a sagittal plane and a plurality of feet. The light source assembly and the light directing fixture are mounted onto the base plate. The two white optics reflectors are mounted within the light directing fixture. The sagittal plane symmetrically traverses through the base plate, the light directing fixture, the light source assembly and the low transparency lens. The two white optics reflectors each is oriented at an acute angle with respect to the sagittal plane. The low transparency lens and the base plate are located parallel to each other. The plurality of feet are peripherally connected with the base plate.

9 Claims, 8 Drawing Sheets

(56) References Cited

U.S. PATENT DOCUMENTS

| | | | | |
|---|---|---|---|---|
| 2013/0010230 | A1* | 1/2013 | Matsuki | G02F 1/1336 349/64 |
| 2013/0208484 | A1* | 8/2013 | Alfier | F21V 17/12 362/294 |
| 2013/0293098 | A1* | 11/2013 | Li | F21V 3/02 313/512 |
| 2014/0268747 | A1* | 9/2014 | Demuynck | F21S 9/022 362/235 |
| 2015/0109793 | A1* | 4/2015 | Dingemans | F21V 29/505 362/294 |

* cited by examiner

RETROFIT LIGHT EMITTING DIODE FIXTURE FOR A BACK BOX

The current application claims a priority to the U.S. Provisional Patent application Ser. No. 62/139,500 filed on Mar. 27, 2015. The current application is filed on Mar. 28, 2016 while Mar. 27, 2016 was on a weekend.

FIELD OF THE INVENTION

The present invention relates generally to light emitting diode fixtures. More specifically, the present invention is a light emitting diode fixture apparatus for a back box.

BACKGROUND OF THE INVENTION

Thermal management has been the focus of light delivery systems as performance lighting increased in popularity. However, the distribution and glare of the light are problems of current light delivery systems with fluorescent light bulbs. Typical lenses engaged with these light delivery systems comprise a material that prevents light from passing through with only eighty-six percent lens transmission, resulting in uneven distribution. A solution to this issue is the use of LED bulbs. The use of LED bulbs has proven to be insufficient in reflecting the light that has bounced back from the lens back through the lens.

The present invention is a light delivery system that offers the best distribution and eliminates the glare of traditional light delivery systems. As the lens material prevents the light emitted from a light source, preferably an LED bulb, from passing through the lens, the white optics material installed on the face of both reflectors successfully directs the light through the lens. The light emitted of the present invention is distributed at a perfect forty degrees. The present invention may be used as a lamp replacement, a linear universal light engine, signage lights, accent lights, roadway lights, and so on.

DETAILED DESCRIPTION OF THE INVENTION

Figure 1:
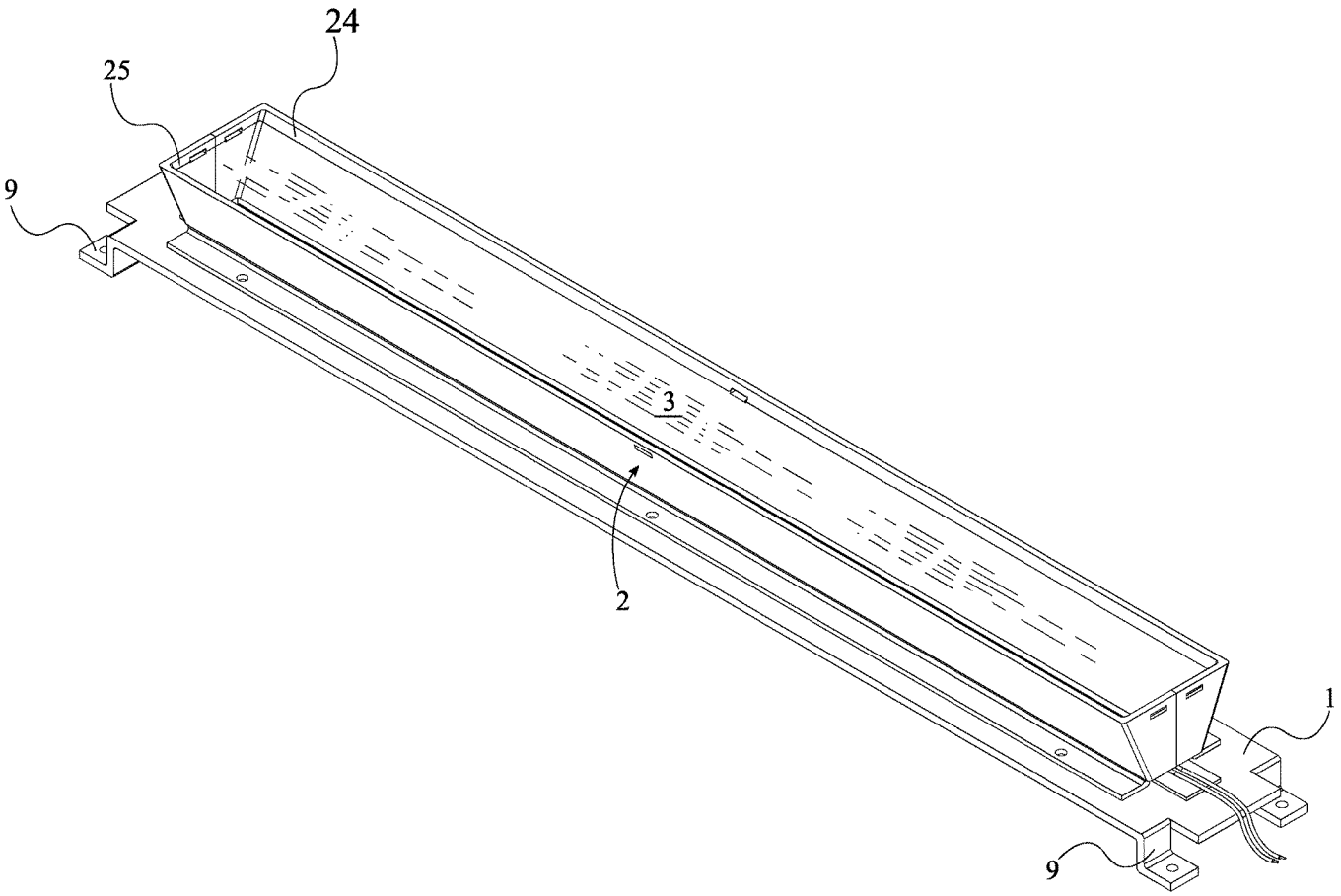
FIGS. 1 through 8 illustrate the present invention.
Figure 2:
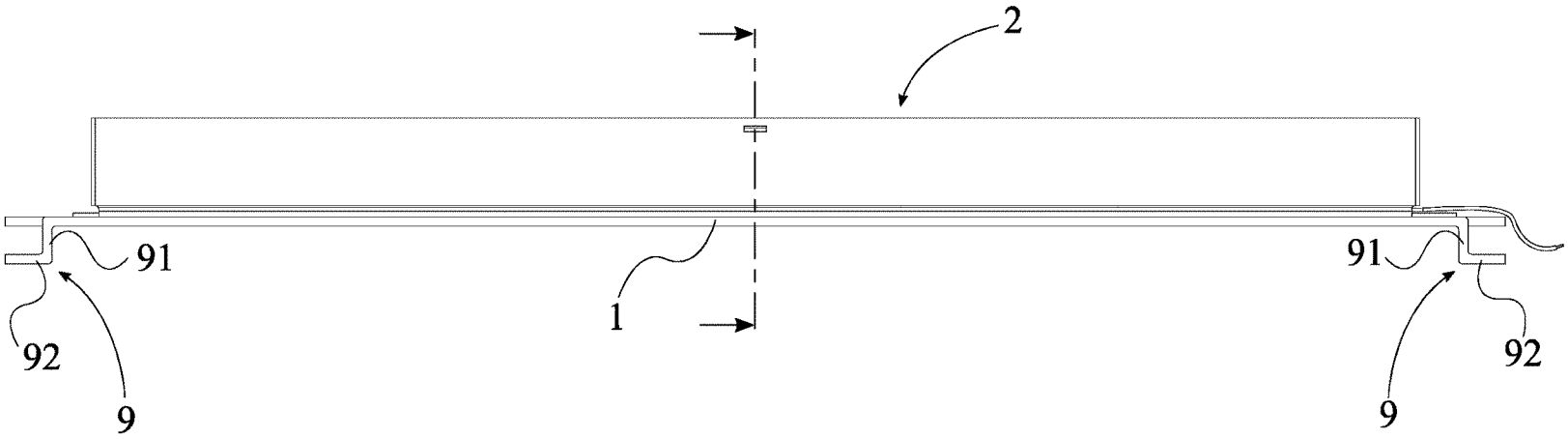
Figure 3:
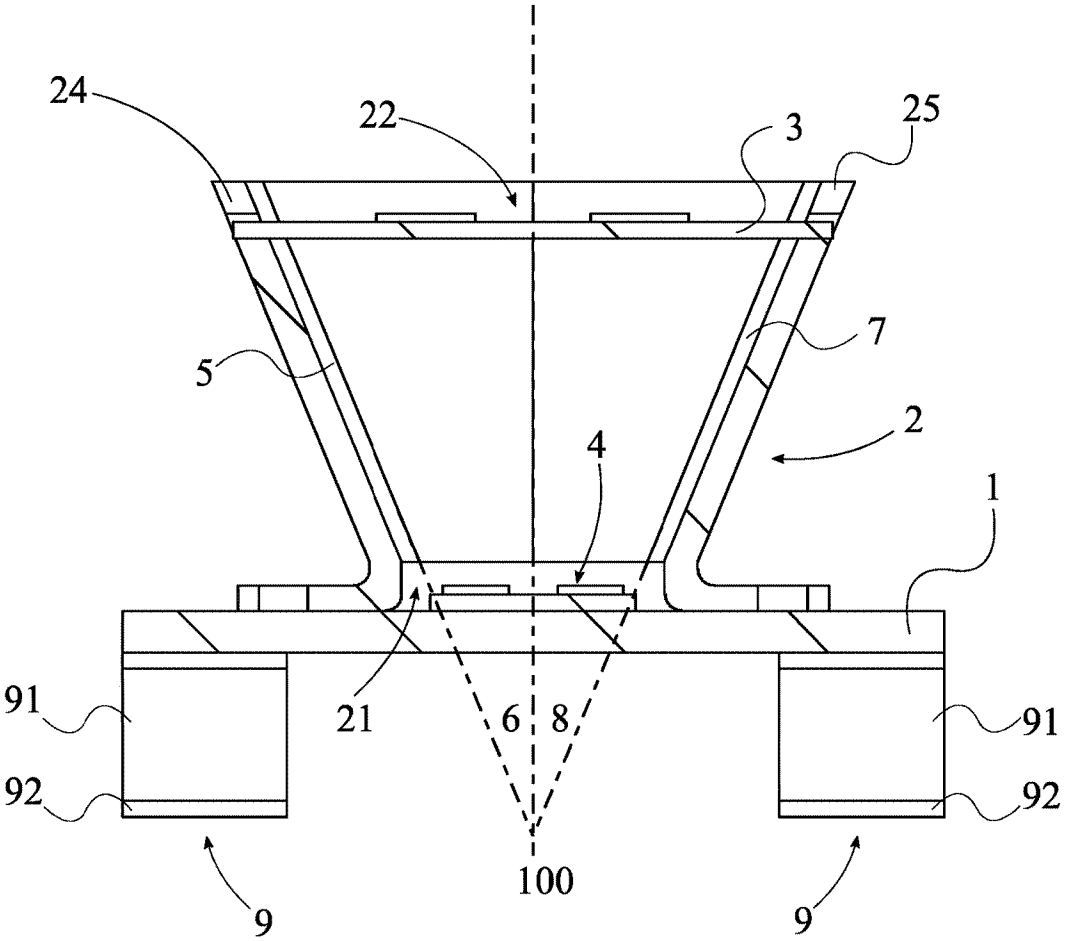
Figure 4:
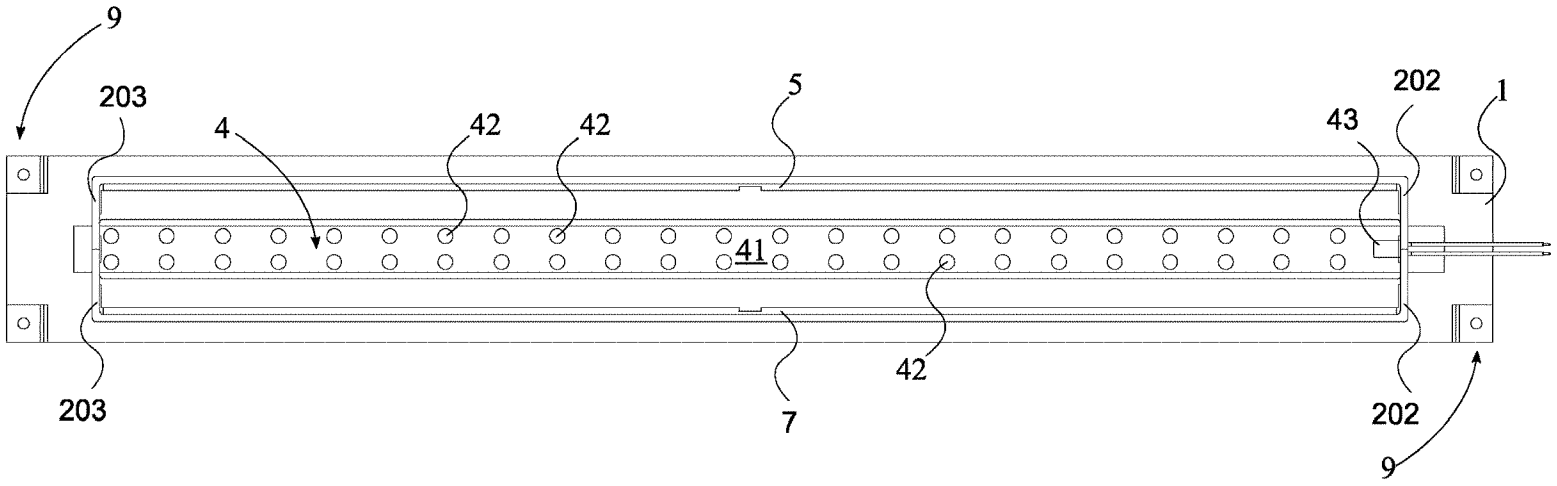
Figure 5:
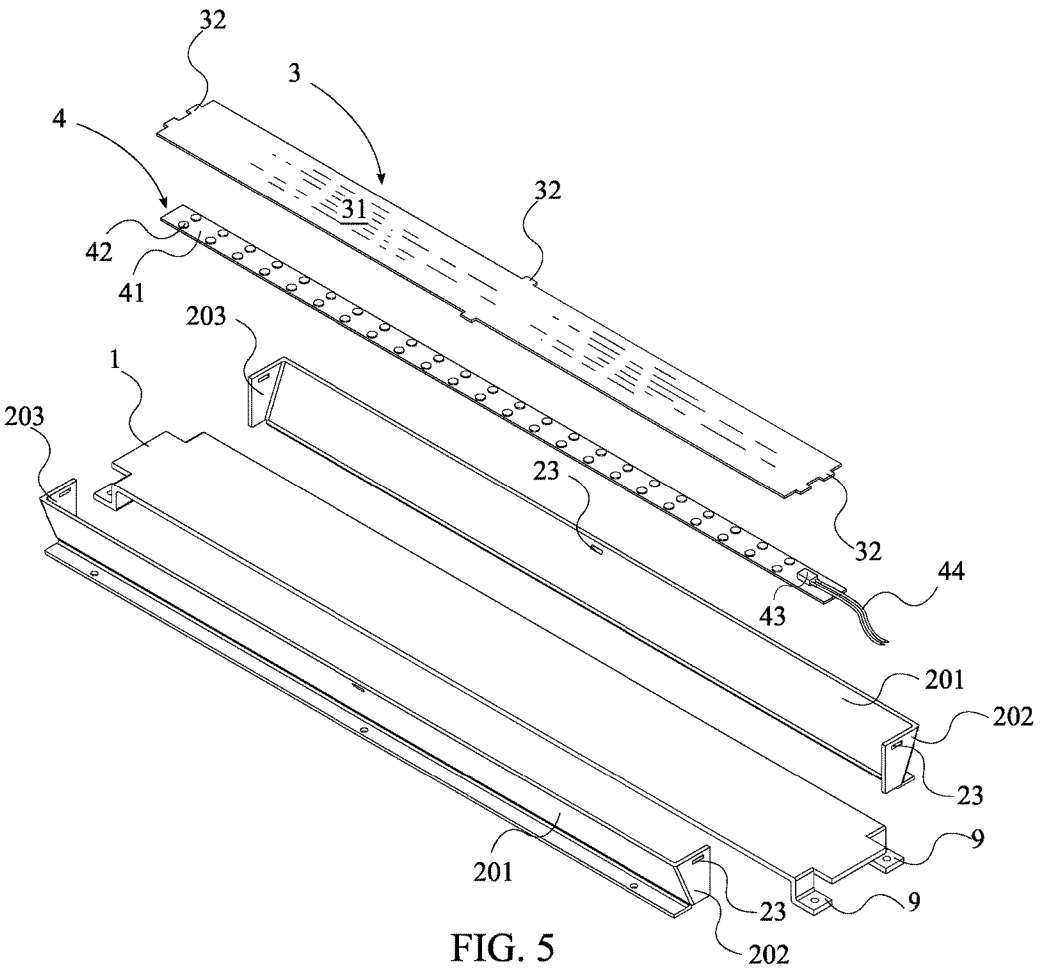
Figure 6:
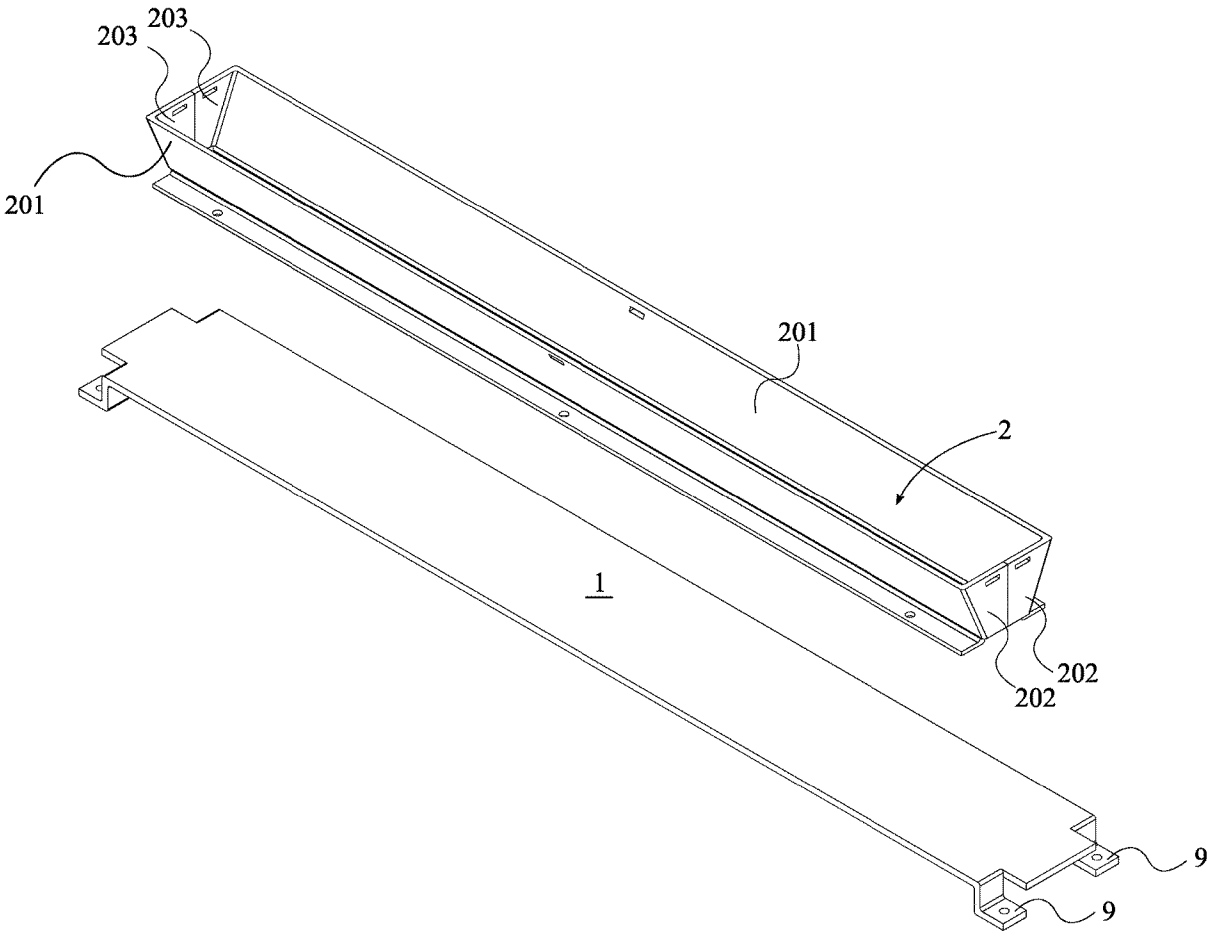
Figure 7:
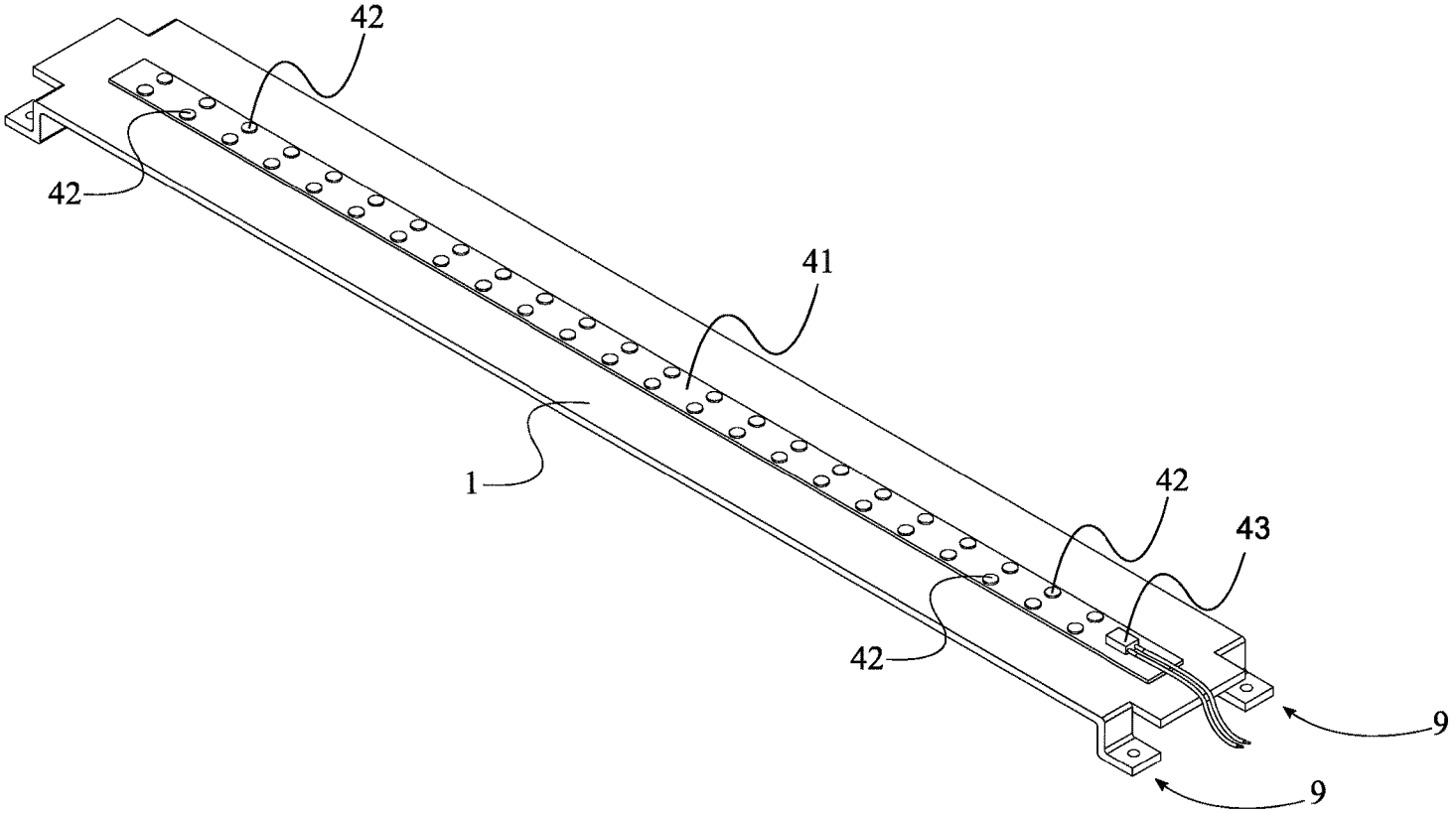
Figure 8:
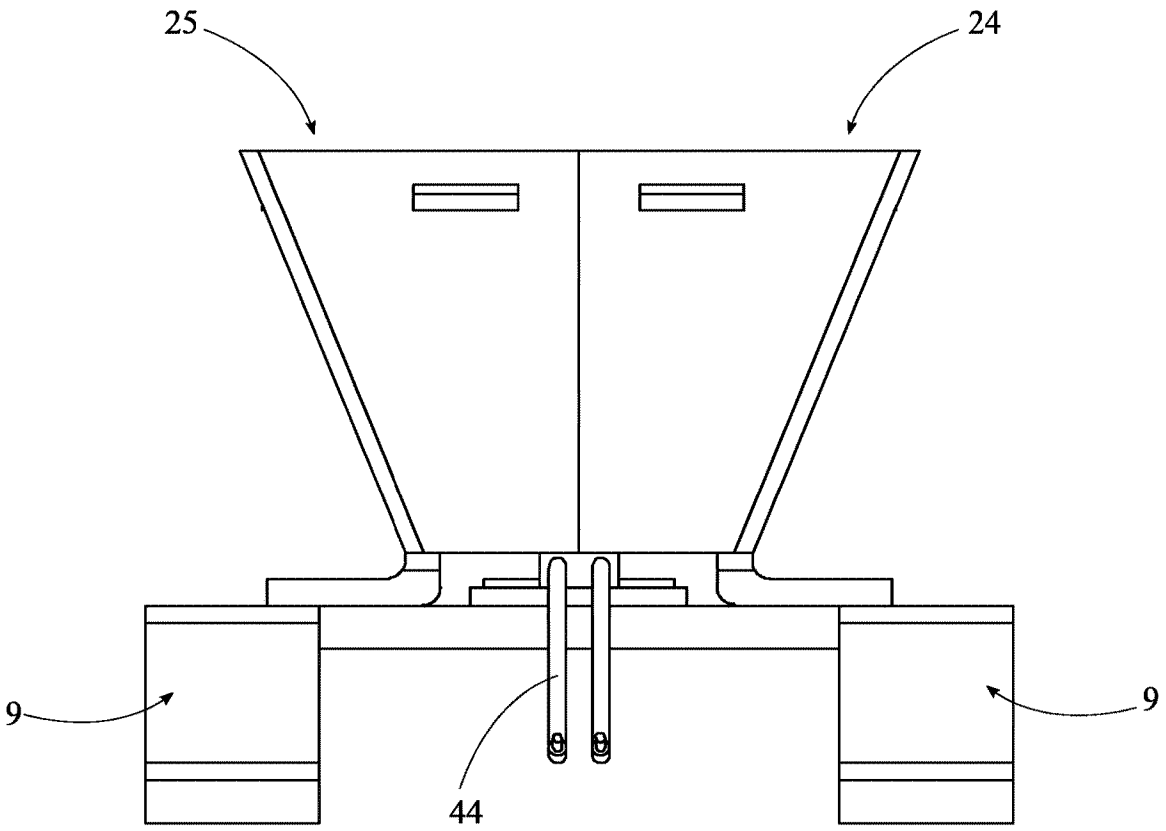

All illustrations of the drawings are for the purpose of describing selected versions of the present invention and are not intended to limit the scope of the present invention.

The present invention is a light emitting diode (LED) fixture apparatus for a back-box that is used in replacement of exiting fluorescent tubes and incandescent lamps. The present invention is designed to be mounted into a variety of light fixture housings. The present invention is also designed to evenly distribute light so that the surrounding area receives the maximum amount of illumination. The present invention comprises a base plate 1, a light directing fixture 2, a low transparency lens 3, a light source assembly 4, a first white optics reflector 5, and a second white optics reflector 7. The base plate 1 provides a structural foundation to connect the other components of the present invention into a back-box or some similar light fixture housing. Light that is emitted by the light source assembly 4 is bounced between the low transparency lens 3 and the first white optics reflector 5 and the second white optics reflector 7, all of which is held in place by the light directing fixture 2. The light bounces back and forth within the light directing fixture

2 until the intensity of the light increases to a point where the light passes through the low transparency lens 3 and generates pure illumination without glare. In the preferred embodiment of the present invention, the low transparency lens 3 is made of a frost acrylic material that has an 86% optical transmission. Also in the preferred embodiment, the first white optics reflector 5 and the second white optics reflector 7 are 98% reflective.

The general configuration of the aforementioned components allows the present invention to efficiently and effectively illuminate its surrounding areas. The light source assembly 4 and the light directing fixture 2 are mounted onto the base plate 1 in order to maintain a constant emission direction for the light generated by the light source assembly 4. The light source assembly 4 is positioned into an input opening 21 for the light directing fixture 2, while the low transparency lens 3 is mounted into an output opening 22 for the light directing fixture 2, which allows the light source assembly 4 and the low transparency lens 3 to be in optical communication with each other through the light directing fixture 2. The first white optics reflector 5 and the second white optics reflector 7 need to be mounted within the light directing fixture 2, which creates a space within the light directing fixture 2 for light to bounce back and forth and build up its intensity before escaping through the low transparency lens 3.

In order to describe the optical path of light through the present invention, a sagittal plane 100 needs to be defined for the present invention. The sagittal plane 100 traverses through the base plate 1, the light directing fixture 2, the light source assembly 4, and the low transparency lens 3 so the sagittal plane creates 100 a bilateral symmetry through the present invention. The first white optics reflector 5 is oriented at a first acute angle 6 with the sagittal plane 100, and the second white optics reflector 7 is oriented at a second acute angle 8 with the sagittal plane 100. Moreover, the first acute angle 6 and the second acute angle 8 are equal in magnitude to each other but are oriented in opposite directions from the sagittal plane 100. This creates a V-shaped formation between the first white optics reflector 5 and the second white optics reflector 7. In the preferred embodiment of the present invention, the first acute angle 6 and the second acute angle 8 are both 20 degrees in magnitude. In addition, the light directing fixture 2 and the base plate 1 are positioned parallel to each other so that the present invention emits light in a normal direction from where the base plate 1 is mounted. The arrangement between the first white optics reflector 5, the second white optics reflector 7, and the low transparency lens 3 allows the light emitted from the light source assembly 4 to bounce several time between the first white optics reflector 5, the second white optics reflector 7, and the low transparency lens 3 in what is known as a fracturing event, which is used to generate the pure illumination with no glare.

The base plate 1 attaches the present invention to a variety of light fixture housings. The base plate 1 is preferably connected to a mounting surface by a plurality of feet 9 that are peripherally connected with the base plate 1. Each of the plurality of feet 9 comprises a first tab 91 and a second tab 92. The first tab 91 and the second tab 92 lift up the base plate 1 from the mounting surface by a certain offset distance. The first tab 91 is perpendicularly connected with the base plate 1. The first tab 91 is used to define the offset distance between the base plate 1 and the mounting surface. The second tab 92 connects the base plate 1 to the mounting surface of a fastener by being perpendicularly connected with the first tab 91. The first tab 91 is located in between the base plate 1 and the second tab 92. In the preferred embodiment of the present invention, the first tab 91 is located perpendicular to the base plate 1, and the second tab 92 is located parallel to the base plate 1. This forms an L-shaped foot via the first tab 91 and the second tab 92 that is able to most effectively receive the load from the base plate 1.

In order to properly secure the low transparency lens 3 in place, the light directing fixture 2 needs to further comprise a plurality of tab-receiving slots 23, while the low transparency lens 3 needs to further comprise a lens body 31 and a plurality of tabs 32. The lens body 31 is responsible for the optical capabilities of the low transparency lens 3. The plurality of tabs 32 is used to secure the positioning of the lens body 31 and are peripherally connected about the lens body 31. The plurality of tab-receiving slots 23 is adjacent to the output opening 22 of the light directing fixture 2 so that each of the plurality of tabs 32 can be engaged to a corresponding slot from the plurality of tab-receiving slots 23.

In some embodiments of the present invention, the light directing fixture 2 is designed to be easily assembled by a user and, consequently, further comprises a left bracket 24 and the right bracket 25, which are mirroring pieces of the light directing fixture 2. The left bracket 24 and the right bracket 25 can be found on opposing sides of the sagittal plane 100. Moreover, the left bracket 24 and the right bracket 25 each comprise a main panel 201, a first lateral wall 202, and a second lateral wall 203. The first lateral wall 202 is positioned adjacent to the main panel 201, and the second lateral wall 203 is positioned adjacent to the main panel 201, opposite the first lateral wall 202. This configuration for the first lateral wall 202, the second lateral wall 203, and the main panel 201 forms the overall shape of either the left bracket 24 or the right bracket 25. Moreover, the first lateral wall 202 of the left bracket 24 is positioned adjacent to the first lateral wall 202 of the right bracket 25, opposite to the main panel 201 of the right bracket 25, and the second lateral wall 203 of the left bracket 24 is adjacent to the second lateral wall 203 of the right bracket 25, opposite to the main panel 201 of the right bracket 25. This configuration between the left bracket 24 and the right bracket 25 forms an enclosure with two open ends (the input opening 21 and the output opening 22) so that the enclosure is able to guide light from the light source assembly 4 to the low transparency lens 3. Consequently, the main panel 201 of the left bracket 24 and the main panel 201 of the right bracket 25 are able to secure the positioning of the first white optics reflector 5 and the positioning of the second white optics reflector 7. This is because the first white optics reflector 5 is mounted across the main panel 201 of the left bracket 24, and the second white optics reflector 7 is mounted across the main panel 201 of the right bracket 25. Also in the preferred embodiment of the present invention, the left bracket 24 and the right bracket 25 are made of aluminum, which allows the present invention to safely function with a heat sink.

The light source assembly 4 is able to used low power electrical components in order to generate the necessary illumination for the present invention. Thus, the light source assembly 4 comprises a base strip 41, a plurality of light emitting diode (LED) bulbs 42, a constant current driver 43, and a power terminal 44. The base strip 41 is mounted onto the base plate 1 and is used to secure the light source assembly 4 to the rest of the present invention. The plurality of LED bulbs 42 is used to generate the light that is necessary to illuminate the surrounding areas of the present invention. The plurality of LED bulbs 42 is mounted onto the base strip 41, opposite the base plate 1, and is distributed along the base strip 41 so that the plurality of LED bulbs 42 is able to evenly illuminate the surrounding areas. In addition, each of the plurality of LED bulbs 42 is electrically connected to the power terminal 44 through the constant current driver 43. The power terminal 44 provides the plurality of LED bulbs 42 with the necessary electrical power, and the constant current driver 43 prevents fluctuations in the electrical power being delivered to the plurality of LED bulbs 42.

Although the invention has been explained in relation to its preferred embodiment, it is to be understood that many other possible modifications and variations can be made without departing from the spirit and scope of the invention as hereinafter claimed.

What is claimed is:

1. An LED fixture apparatus comprising:

a base plate;

a light directing fixture;

a low transparency lens;

a light source assembly;

a first white optics reflector;

a second white optics reflector;

a sagittal plane;

the light directing fixture comprising an input opening and an output opening;

the light source assembly and the light directing fixture being mounted onto the base plate;

the light source assembly being positioned into the input opening;

the first white optics reflector and the second white optics reflector being mounted within the light directing fixture;

the low transparency lens being positioned into the output opening;

the sagittal plane symmetrically traversing through the base plate, the light directing fixture, the light source assembly and the low transparency lens;

the first white optics reflector being oriented at a first acute angle with respect to the sagittal plane;

the second white optics reflector being oriented at a second acute angle with respect to the sagittal plane;

the first acute angle and the second acute angle being equal in magnitude to each other and being oriented in opposite directions from the sagittal plane;

the low transparency lens and the base plate being located parallel to each other; and an arrangement and optics properties among the first white optics reflector, the second white optics reflector and the low transparency lens inducing a fracturing event of a light emitted from the light source assembly so as to generate a pure illumination with no glare.

2. The LED fixture apparatus as claimed in claim 1 comprising:

the light directing fixture comprising a plurality of tab-receiving slots;

the low transparency lens comprising a lens body and a plurality of lens tabs;

the plurality of tab-receiving slots being located adjacent to the output opening;

the plurality of lens tabs being peripherally connected with the lens body; and each of the plurality of lens tabs being engaged to a corresponding slot from the plurality of tab-receiving slots.

3. The LED fixture apparatus as claimed in claim 1 comprising:

the first acute angle being 20 degrees in magnitude; and the second acute angle being 20 degrees in magnitude.

4. The LED fixture apparatus as claimed in claim 1 comprising:

the light directing fixture comprising a left bracket and a right bracket;

the left bracket and the right bracket each comprising a main panel, a first lateral wall and a second lateral wall;

the first lateral wall being located adjacent to the main panel;

the second lateral wall being located adjacent to the main panel, opposite to the first lateral wall;

the first lateral wall of the left bracket being located adjacent to the first lateral wall of the right bracket, opposite to the main panel of the right bracket; and the second lateral wall of the left bracket being located adjacent to the second lateral wall of the right bracket, opposite to the main panel of the right bracket.

5. The LED fixture apparatus as claimed in claim 4 comprising:

the first white optics reflector being mounted across the main panel of the left bracket; and the second white optics reflector being mounted across the main panel of the right bracket.

6. The LED fixture apparatus as claimed in claim 4 comprising:

the light directing fixture comprising a plurality of tab-receiving slots;

the plurality of tab-receiving slots being formed on the main panel, the first lateral wall and the second lateral wall of the left bracket and the main panel, the first lateral wall and the second lateral wall of the right bracket;

the low transparency lens comprising a lens body and a plurality of lens tabs;

the plurality of tab-receiving slots being located adjacent to the output opening;

the plurality of lens tabs being peripherally connected with the lens body; and each of the plurality of lens tabs being engaged to a corresponding slot from the plurality of tab-receiving slots.

7. The LED fixture apparatus as claimed in claim 1 comprising:

the light source assembly comprising a base strip, a plurality of LED bulbs, a constant current driver and a power terminal;

the base strip being mounted onto the base plate;

the plurality of LED bulbs being distributed along the base strip;

the plurality of LED bulbs being mounted onto the base strip, opposite the base plate; and each of the plurality of LED bulbs being electrically connected to the power terminal through the constant current driver.

8. The LED fixture apparatus as claimed in claim 1 comprising:

a plurality of feet;

the plurality of feet being peripherally connected with the base plate;

each of the plurality of feet comprising a first tab and a second tab;

the first tab being connected with the base plate;

the second tab being connected with the first tab; and the first tab being located in between the base plate and the second tab.

9. The LED fixture apparatus as claimed in claim 8 comprising:

the first tab being perpendicularly connected with the base plate;

the second tab being perpendicularly connected with the first tab; and the second tab being located parallel to the base plate.

* * * * *